United States Patent [19]

Ozaki et al.

[11] 4,205,988

[45] Jun. 3, 1980

[54] PHOTOCHROMIC METHOD INVOLVING AN AROMATIC AMINE

[75] Inventors: Masaru Ozaki; Koichi Mori; Masatsugu Yoshino, all of Fuji, Japan

[73] Assignee: Asahi Kasei K. K., Japan

[21] Appl. No.: 34,279

[22] Filed: Apr. 30, 1979

Related U.S. Application Data

[63] Continuation of Ser. No. 820,647, Aug. 1, 1977, abandoned, which is a continuation-in-part of Ser. No. 518,994, Oct. 29, 1974, abandoned.

[30] Foreign Application Priority Data

Oct. 29, 1973 [JP] Japan ..... 48-120714

[51] Int. Cl.[2] ..... G03C 5/04

[52] U.S. Cl. ..... 430/340; 430/944; 430/945; 430/444

[58] Field of Search ..... 96/27 E, 119 PO, 48 OP, 96/48 R, 95, 100, 3, 55, 90 PC, 90R; 252/300

[56] References Cited

U.S. PATENT DOCUMENTS

| | | | |
|---|---|---|---|
| 2,410,644 | 11/1946 | Fierke et al. | 96/95 |
| 3,227,550 | 1/1966 | Whitmore et al. | 96/3 |
| 3,322,542 | 5/1967 | Ullman et al. | 96/90 PC |
| 3,635,544 | 1/1972 | Stamm et al. | 96/90 PC |
| 3,767,393 | 10/1973 | Fox | 96/1.5 |
| 3,825,427 | 7/1974 | Inoue et al. | 96/90 PC |

OTHER PUBLICATIONS

Gailite et al., Zh. Vses Khim Obshchest, May, 1973, 18(2), 237–238.

Myer, J. Phys. Chem., May, 1970, 74(10), 2122–2126.

Chem. Abs., vol. 74, 1971, 54881j.

Chem. Abs., vol. 66, 1967, 120822d.

Cadogan et al., The Journal of Physical Chemistry, vol. 72, No. 3, Mar., 1968, 929–944.

Meyer, The Journal of Physical Chemistry, vol. 74, No. 10, May, 1970, 2118–2121.

*Primary Examiner*—Won H. Louie, Jr.

*Attorney, Agent, or Firm*—Cooper, Dunham, Clark, Griffin & Moran

[57] ABSTRACT

Photochromic method utilizing photochromic compositions in which the intensity of color generation is not proportional to light intensity which are produced by incorporating an aromatic amine with a low ionization potential, up to 7.6 EV so that it can be ionized by biphotonic absorption into a stabilizing polymer matrix.

18 Claims, 6 Drawing Figures

(A) O.D. AS ABSORPTION PEAK VALUE AT 470nm

PHOTOCHROMIC METHOD INVOLVING AN AROMATIC AMINE

RELATED APPLICATION

This is a continuation, of application Ser. No. 820,647 filed Aug. 1, abandoned 1977, which in turn is a continuation-in-part of Appln. Ser. No. 518,994 filed Oct. 29, 1974, now abandoned.

BACKGROUND OF THE INVENTION

Photochromic substances are generally chemical compounds which undergo a reversible cycle of coloration and color extinction upon exposure respectively to ultraviolet light (200 to 400 nm) and then to either visible light, infrared light or heat. A number of such compounds are known in the art, and a variety of commercial uses are known or have been proposed.

Because there is no necessity for developing the image as in conventional silver halide photography, or in various electrophotographic procedures which depend upon the use of photoconductive materials and the deposition of toner particles, photochromic reactions have found special utility in dry photography, holograms, radiation dosimeters and the like. They have recently been proposed for use in data display units, photomasking techniques and in camouflage applications.

Advances in commercial applications for photochromism have been retarded for a number of reasons. One of these is that the most useful photochromic compounds, the spiropyrans and the mercury bis dithizonates are complex organic compounds which are difficult and expensive to produce. Another is that the sensitivity of presently known photochromic systems is low, and that they will undergo only a limited number of photochromic cycles, that is, cycles of alternate photocoloration and photoextinction.

The art, therefore, has long sought methods to produce photochromic systems which are inexpensive to prepare, of high sensitivity, and capable of undergoing a large number of photochromic cycles.

THE INVENTION

Methods have now been discovered based on the finding that certain amines, many of which are quite inexpensive, can be dispersed in a polymer matrix to form a photochromic system of high sensitivity which will undergo a large number of photochromic cycles. The amines utilizable in this invention are characterized by a low ionization potential which is not more than 7.6 eV, and by the presence of electropositive or electron donating groups substituted on an aromatic nucleus. Useful polymers may be thermosetting or thermoplastic, and will characteristically form a rigid, stabilizing matrix at room temperature.

It has been discovered that certain amines when subjected to high intensity light radiation will absorb two photons of energy and become photoionized by the emission of an electron. The phenomenon is called biphotonic absorption. The selected polymer must be one which will stabilize the cationic species which is formed.

A typical amine which is useful for the practice of this invention is N,N,N',N'-tetramethyl-p-phenylenediamine (TMPD). This amine, which has an ionization potential of 6.5 eV when dispersed in a polymer such as polymethyl methacrylate and subjected to high intensity light from a steady source or from a pulse or flash source will become colored. If the system is allowed to stand at ambient temperature, the color will be retained for several days, even in an artificially lighted room. However, if the photocolored system is heated or exposed to infrared light, the color can be extinguished. The photochromic cycle can be repeated more than thirty times.

The photochromic phenomena of this invention will be explained by reference to FIG. 1 which is an energy diagram in which $S_o$ represents a molecule in the ground singlet state, $S_1$, a molecule in the first excited singlet state, $T_1$, a molecule in the first excited triplet state and $T_2$, a molecule in a higher excited triplet state. In the figure $h\nu$ and $h\nu'$ represent photons of light energy. One form of photochromism utilizes the conversion of a molecule from the $T_1$ to the $T_2$ state by the absorption of a photon of light energy $h\nu'$. In contrast, in the biphotonic absorption process of this invention the molecule absorbs two photons of energy and is photoionized giving rise to a photoionized state comprising a cation and a free electron. For the practice of this invention, the photoionizable molecules are substantially colorless substituted amines, the cations of which are highly stabilized by resonance energy and are colored. The components of the photoionized state are further stabilized by dispersion in a rigid polymer, preferably one in which electronegative groups are substituted along the chain, to capture the released electrons. Upon standing under ambient conditions for an extended period of time, exposure to infrared light or heat energy, the cations and the electrons recombine so that the molecule in the photoionized state returns to its original colorless state.

Since in this invention the generation of color is caused by photoionization due to biphotonic absorption, the intensity of color generation is not proportional to the light intensity of the energy source. Instead, it is proportional to the square of the light intensity of the source. This is a characteristic of the photochromic systems of the invention. Substantially no color is generated, even in a brightly lit room. Under a pulse light of short time span and high intensity the systems of this invention exhibit a sensitivity which may be as much as 150 to 200 times the sensitivity which can be obtained under steady light from an ultra-high pressure mercury lamp of a lower light intensity, even though the total number of photons from both sources may be equal.

In sharp contrast to the photochromic behavior of ordinary photochromic compounds such as spiropyrans, the photochromic systems of this invention are not extinguished by exposure to light in the visible region of the spectrum. Such color extinction must be accomplished utilizing heat energy or infrared light. Ordinary photochromic systems are deprived of color when left standing in an artificially lighted room for a short time.

One unexpected aspect of this invention is the discovery that the aromatic amines of low ionization potential which are employed manifest high coloring sensitivity in rigid polymer matrices. Organic photochromic substances generally exhibit such high sensitivity in solutions, but not in rigid matrices.

A particular advantage of this invention is the sensitivity of the systems to pulse light of high intensity and rapid pulse span. The reason for this is that organic molecules in the $T_1$ state are rapidly returned to a lower energy state, or quenched, by oxygen. Therefore, when a lengthy irradiation time is required to generate a color, the reverse reaction of color extinction is taking place concurrently. One result of this is that the number of photochromic cycles which will take place is reduced. The advantage of pulse light, therefore, is that it permits improvements in color sensitivity and number of permissible photochromic cycles, because the irradiation time for color generation is short and the period of color extinction while the molecule is in the $T_1$ state is diminished.

BRIEF EXPLANATION OF THE DRAWINGS

FIG. 3A represents the variation in intensity of color generation as a function of the total exposure. FIG. 3B represents the variation in color intensity as a function of time of exposure to a 250 W infrared lamp. FIG. 3C represents the variation of color degradation as a function of the time of exposure to a 250 W infrared lamp.

In the figures the solid line records behavior when the energy source is a 500 W Xe flash light and the dotted line represents behavior when the energy source is a 500 W ultra-high pressure Hg lamp.

Figure 4:
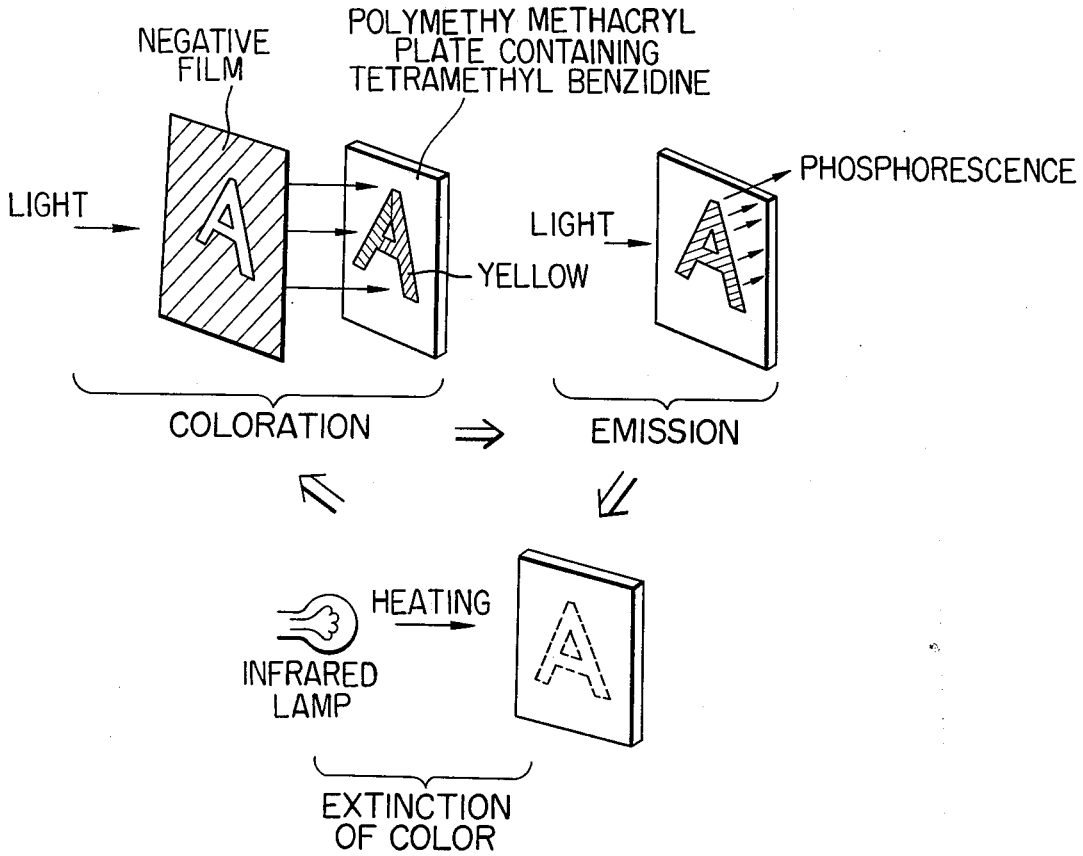

FIG. 4 is a representation of the operating principle of the invention for converting a negative to a colored image and thereafter extinguishing the image. The figure also includes a phosphorescence feature of this invention which will be explained in detail hereinafter.

DETAILED DESCRIPTION OF THE INVENTION

While a variety of aromatic amines with a low ionization potential can be employed in the practice of this invention, the preferred are those represented by the formula:

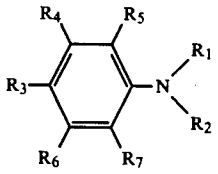

wherein:

$R_1$, $R_2$ and $R_4$ to $R_7$ are hydrogen, lower alkyl, lower alkoxy, allyl, substituted allyl, phenyl, substituted phenyl, amino and substituted amino; substituents in such substituted allyl, phenyl and amino groups being electron donating groups such as amino, lower alkyl, and lower alkoxy groups; the term "lower" here, and elsewhere in the specification referring to alkyl (including cycloalkyl), alkoxy and like groups containing up to about twelve carbon atoms;

$R_3$ is one of the functional groups included in the definition of $R_1$, $R_2$ and $R_4$ to $R_7$ wherein a substituent on a substituted amino group is an electron donating group such as allyl or phenyl.

While the preferred compounds used in this invention have been illustrated as phenyl compounds, it will be appreciated that the aromatic amines of this invention may be polycyclic aromatic amines, but that monocyclic, bicyclic and tricyclic aromatic amines are normally most suitable because of the relative ease with which such compounds can be obtained.

Specific examples of aromatic amines with ionization potentials of from about 5.0 eV to 7.6 eV which are especially preferred for use in this invention include:

N-methyl aniline
N,N-dimethyl aniline
p-phenylenediamine
σ-phenylenediamine
N-methyl-p-phenylenediamine
N,N-dimethyl-p-phenylenediamine
N,N'-dimethyl-p-phenylenediamine
N,N,N',-trimethyl-p-phenylenediamine
N,N,N',N'-tetramethyl-p-phenylenediamine
N-ethyl aniline
N,N-diethyl aniline
N,N-diethyl-p-phenylenediamine
N,N'-diethyl-p-phenylenediamine
N,N,N',N'-tetraethyl-p-phenylenediamine
N,N-dimethoxy-p-phenylenediamine
N-methyl-N-methoxy-p-phenylenediamine
N-allyl-N-methyl-p-phenylenediamine
N-(1-methyl allyl)-p-phenylenediamine
N,N-diallyl-p-phenylenediamine
N-phenyl aniline
N,N-diphenyl aniline
N,N,N'-triphenyl-p-phenylenediamine
N,N,N',N'-tetraphenyl-p-phenylenediamine
N-(p-methoxyphenyl)-N-methyl-p-phenylenediamine
tris-(p-methylphenyl) amine
N-n-amyl aniline
N-n-butyl aniline
N-n-butyl-N-methyl aniline
N-cycloheptyl aniline
N-cycloheptyl-N-methyl aniline
N-cyclohexyl aniline
N-cyclopentyl aniline
N-n-decyl aniline
N,N-di-n-butyl aniline
4,4''-diaminodiphenyl methane
N,N-di-n-decyl aniline
N,N-di-n-octyl aniline
N,N-di-n-propyl aniline
N-n-dodecyl aniline
N-n-hexyl aniline
N-n-heptyl aniline
N-n-nonyl aniline
N-n-octyl aniline
N-propyl aniline
N-isopropyl aniline
σ-toluidine
m-toluidine
p-toluidine
α-naphthylamine
β-naphthylamine
1,5-naphthylenediamine
phenylhydrazine
N,N-diphenylhydrazine
N,N,N'-triphenylhydrazine
N,N,N',N'-tetraphenylhydrazine These amines which are presently most preferred, principally because they have ionization potentials of not more than 7.6 eV so that photoionization and color formation readily takes place, are listed below along with their ionization potentials:

N,N,N',N'-tetramethyl-p-phenylenediamine—6.5 eV
N,N-dimethyl-N',N'-diphenyl-p-phenylenediamine—6.5 eV
N-methyl-N-(p-methoxyphenyl)-p-phenylenediamine—7.0 eV
N-methyl aniline—7.3 eV
β-naphthylamine—7.3 eV
N,N-dimethyl aniline—7.1 eV
phenylhydrazine—7.6 eV
p-toluidine—7.5 eV If the aromatic amine selected for the photochromic systems of this invention is benzidine or a benzidine derivative such as a phenylimino compound, the system takes on the added feature of phosphorescence after a time lag required for color generation.

Such benzidine derivatives as N,N,N',N'-tetramethyl benzidine (hereinafter abbreviated as TMB, Ip=6.4 eV) undergo photoionization in polymer matrices at room temperature because of biphotonic absorption. The photoionization brings about formation of cations and the production of color. After the production of color, phosphorescence appears. This phosphorescence exhibits a long lifetime of 10 to 20 seconds and, what is more important, its intensity is enhanced at a proper cation concentration. This system resumes its original colorless state when it is exposed to infrared light or heat so as to cause recombination of cations and electrons. After extinction of the color further exposure to light fails to bring about phosphorescence without intervening photocoloration. The benzidine compounds of this invention, when used in the photochromic systems of the invention, exhibit phosphorescence of a higher intensity and a longer life than any other known organic compounds. The phosphorescence is an emission with a time lag.

The benzidine derivatives usable for the present invention are those represented by the following generic formula:

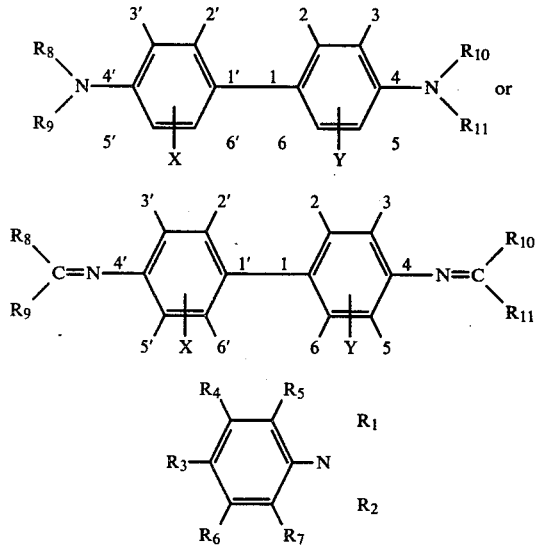

wherein $R_1$, $R_2$ and $R_4$ to $R_7$ are hydrogen, lower alkyl, lower alkoxy, allyl, substituted allyl, phenyl, substituted phenyl, amino and substituted amino, said substituents being selected from the group consisting of amino, lower alkyl and lower alkoxy; $R_3$ being the same as $R_1$, $R_2$ and $R_4$ to $R_7$, except that the substituents when on an amino group are selected from the group consisting of allyl and phenyl; $R_8$ to $R_{11}$ being selected from the group consisting of hydrogen, lower alkyl, phenyl, substituted phenyl, amino, substituted amino, allyl and substituted allyl, substituted having the same meaning as defined above in connection with substituents on $R_1$, $R_2$ and $R_4$ and $R_7$ groups; and X and Y being selected from the group consisting of from 0 to 4 $R_1$, $R_2$, $R_4$ to $R_7$ groups and halogen and sulfonate groups.

Typical examples of useful compounds for the production of phosphorescence include:

benzidine
N,N-dimethylbenzidine
N,N-dimethylbenzidine
N,N,N',N'-tetramethylbenzidine
N,N,N',N'-tetraphenylbenzidine
2,2'-dimethoxybenzidine
3,3'-dimethoxybenzidine
2,2'-dichlorobenzidine
3,3'-dichlorobenzidine
N,N'-bisbenzilidene benzidine
N,N'-bisbenzilidene-3,3'-dichlorobenzidine
N,N'-bisbenzilidene-3,3'-dimethoxybenzidine
N,N'-bis (p-methoxybenzilidene) benzidine
N,N'-bis-(p-methoxybenzilidene)-3,3'-dichlorobenzidine
N,N'-bis-(p-methoxybenzilidene)-3,3'-dimethoxybenzidine The polymer matrix of this invention is specifically selected to prolong the lifetime of the $T_1$ state and to effectively capture or stabilize the cations and electrons generated by photoionization. The stabilizing polymer matrix may be thermoplastic or thermosetting. The presently preferred polymers are characterized by a rigid matrix and by the presence of polar groups along the polymer chain. Ideally the polymers should be transparent to light. The polymer may be one which is formed or cured by any of the usual condensation or addition reactions including free radical condensation reactions effected by thermal or radiation-energy, or by the use of peroxides or azo compounds. Radiation energy sources include light rays, gamma rays, X-rays and high energy electron beams.

Desirable thermoplastic polymers are those which are rigid and excellent in penetrability to light and are preferably possessed of such polar group as —OH, —Cl, —CN, —$CONH_2$, —F, —SH, —$SO_3H$, —$NO_2$, —COOH, —$COOCH_3$, epoxy group or N-hetero ring group in the main chain or side chain thereof. For example, there can be cited acrylic polymers such as polymethyl methacrylate, styrenic polymers such as polystyrene, polyesters such as polycarbonate, polyethers such as polyethylene oxide, polyamides such as nylon 6,6, olefinic polymers such as polyethylene, cellulosic polymers such as ethyl cellulose, polyvinyl chloride, polyvinylidene chloride, polyvinyl acetate, polyglycidyl methacrylate, poly-N-vinyl carbazole and copolymers thereof. Among these thermoplastic polymers polymethyl methacrylate and polystyrene and the like prove to be particularly advantageous polymer binders in the sense that they exhibit high penetrability to light and high rigidity of glass transition temperature (Tg) of not less than 300° K. Among the polymers containing in the main chain or side chain thereof a polar group, particularly desirable are polyacrylonitolile, polyvinyl chroride, polyvinylidene chroride, cellulosing polymer and the like. These polymers are desired to have a molecular weight in the range of from about 10,000 to 500,000.

Desirable photocrosslinking polymers or thermocrosslinking polymers are those which are rigid and provide high penetrability to light.

Generally, in order for a given polymer matrix to exhibit rigidity, it is required to satisfy various factors. The presence of the polar group in the main chain or the side chain is a major factor and it is an essential requirement for safe capture of the formed electrons. Further, the fact that the high degree of cross-linking of the polymer involved is also an important requirement for the improvement of polymer rigidity. The preferred polar groups used for this purpose include those containing O,S,N,P, halogens, etc. Besides, aromatic rings can also serve as polar groups. The polymerization degree is preferable to have at least one cross-link per 1,000 repeating units thereof. The polymers which are cross-linked by light are polyvinyl alcohol-cinnamic acid ester and other similar polymers wherein side chains are partially dimerized photochemically to bind and cross-link polymer chains, polymers which incorporate low molecular azide compounds or diazonium compounds or have these compounds added to the high molecular side chains and which are cross-linked by virtue of photolytically formed radicals, and polymers wherein vinyl type or vinylidene type monomers are photochemically cross-linked into their corresponding polymers. These so-called photosensitive resins have already been treated in various pieces of literature. One example is "Photosensitive Resins," written by Warashina, Kai and Mizuno and published by Nikkan Kogyo Shimbun-Sha in 1972.

To serve as media in the photochromic substances, the polymers which are cross-linked by light as described above preferably contain, in the main chain or side chain thereof, at least one element or group selected from the class consisting of O, N, S, P, halogens and aromatic rings.

The polymers which are cross-linked by virtue of heat include thermosetting resins represented by phenol resins, formalin resins, urea-formalin resins and melamine-formalin resins and polymers which are cross-linked by heat at a later stage such as, for example, unsaturated polyester resins, epoxy resins and polyester acrylate resins.

Concrete examples of these polymers are described in detail in the chapter titled "Thermosetting Plastics", in pages 123 through 308 of "Plastics Handbook," (revised edition) published by Asakura Shoten in 1969. To be specific, these examples include phenol resins, furan, resins, urea resins, melamine resins, aniline resins, alkyd resins, unsaturated polyester resins, epoxy resins, triallylcyanurate resins, acrolein type resins, phosphonitrile dihalogen type derivative resins, dimaleimide type resins, thermosetting resins derived from cyclopentadiene, resins of using crosslinking reaction systems started with cyclic polyurea and triazine type resins, etc.

Desirable photocrosslinking polymers or thermocrosslinking polymers are unsaturated polyesters and epoxy polymers, for example. In the case of unsaturated polyesters, for example, advantageous are those which are formed by the combination of such unsaturated acids as maleic anhydride, fumaric acid, phthalic anhydride and terephthalic acid with such dihydric alcohols as diallyl alcohol, ethylene glycol, diethylene glycol, dipropylene glycol and hydrogenated bisphenol-A, namely, diallyl phthalate, diallyl fumarate, ethylene phthalate, ethylene fumarate, etc. Among the epoxy polymers, particularly disirable are aliphatic and alicyclic epoxy polymers such as, for example, vinyl cyclohexene oxide and 3,4-epoxy-6-methyl cyclohexylmethyl which has no aromatic ring in the main chain or side chain. As the epoxy polymer curing agent, there may be used either an amine type curing agent or an acid anhydride type curing agent. Desirable curing agents are aliphatic polyamines such as ethylene tetramine and ethylenetriamine, etc.

These polymers which are cross-linked by light or heat are generally formed by having a low molecular polycondensates rigidified by a cross-linking reaction initiated by light or heat. Therefore, aromatic amines are desired to be incorporated in the reaction systems prior to initiation of the crosslinking reaction. As the polar group, such polymer which is cross-linked by light or heat will often contain, in the main chain or side chain thereof, at least one group selected from the class consisting of hydroxyl, chloro, cyano, amido, fluoro, nitro, mercapto, sulfonyl, carboxyl, carbalkoxyl, epoxy and N-hetero rings. The degree of substitution is not limited, although the larger the polar group and the more complete the degree of substitution, the more satisfactory is the result. Examples of such polar groups are cited below. The present invention is not limited to these examples, however.

$-F, -Cl, -Br, -I, -OH, -NO_2, -C\equiv N,$ (1)

$-NH_2, -COOH, >C=O, -\underset{\underset{O}{\|}}{C}-NH_2, -SH, -SO_3H,$ $-OSO_3Na, -\underset{\underset{O}{\|}}{P}\begin{matrix}ONa\\ONa\end{matrix}, -SO_3Na,$

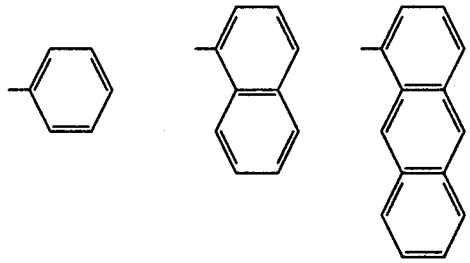

(2)

$R-\bigcirc, R-\bigcirc-O-, R-\underset{\underset{O}{\|}}{C}-\overset{H}{N}-, R-O-,$ $R-NH-, R-\underset{\underset{O}{\|}}{C}-CH_2-, R-O-\underset{\underset{O}{\|}}{C}-, -SO_3R, -NHR,$ $-NR_2; -\underset{\underset{O}{\|}}{C}-NHR, -\underset{\underset{O}{\|}}{C}-NR_2, -SR$ (Wherein, R denotes a lower alkyl group)

$-CH_2-O-CH_2, -\underset{\underset{O}{\|}}{C}-NH-, \underset{\underset{O}{\|}}{C}-O-, -CH_2-S-CH_2-,$ (3)

-continued

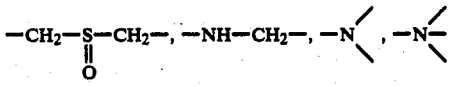

The preferred polymers are those which contain in the main chain an aromatic ring, or an ether, ester, amide or amino band; and in the side chain an aromatic ring, or and hydroxyl, alkoxyl, amino, sulfonate or halogen group.

It is to be noted that the polymers which are cross-linked by light or heat are also capable of being cross-linked by means of radial rays (X rays, gamma rays and electron rays) and energies such as of supersonic waves besides the method resorting to use of light or heat.

The amount of aromatic amine which will be included in a photochromic system of the invention may vary over a very wide range, from an amount which gives a barely perceptible coloration to an amount which gives high intensity coloration. It has been observed, however, that particularly high quantities of amine tend to reduce the sensitivity of the system. The most useful range is from about $10^{-5}$% to 10% by weight, based on the total weight of the polymer matrix, with $10^{-2}$% to 2% being preferred. To attain phosphorescence the amount of benzidine or benzidine derivative employed will normally be in the range of from about $10^{-4}$% to 25% by weight, with $10^{-2}$% to 2.5% by weight being preferred.

The sensitivity of the photochromic systems of the invention can be markedly improved by the addition of a sensitizer of high electron affinity such as an aromatic nitro compound or a quinone. While optimum sensitization will depend upon the particular aromatic amine in the photochromic system, it is generally found that best results are obtained with sensitizers having electron affinities of from about 0.5 eV to 2.5 eV.

Typical examples of useful aromatic nitro compounds and quinones which are useful as sensitizers include:

nitrobenzene
1,3-dinitrobenzene
1,4-dinitrobenzene
1,3,5-trinitrobenzene
o- or p-nitrotoluene
2,4-dinitrotoluene
2,4,6-trinitrotoluene
1-nitronaphthalene
1-nitropyrene
1,8-dinitropyrene
9-nitroanthracene
5-nitroacenaphthene
9-nitrofluorenone
p-nitrodimethyl aniline
p-nitroaniline
2-chloro-r-nitroaniline
2,6-dichloro-4-nitroaniline
2,4-dinitroaniline
p-nitrophenol
2,4,6-trinitrophenol
2,4,6-trinitroaniline
4-nitro-2-chloroaniline
5-nitro-2-aminotoluene
4,4'-dinitrobiphenyl
5-nitro-6-benzoylacenaphthene
5,6-dinitroacenaphthene
2-nitrofluorene
2,7-dinitrofluorene
4-chloro-1,8-phthaloyl naphthalene
5,6-dinitroacenaphthene
o-quinone
p-quinone
2,6-dichloroquinone
chloranil
2,5-diphenyl-p-quinone
acetyl-p-benzoquinone
bromo-p-benzoquinone
p-bromoanil
indo-p-benzoquinone
methyl-carboxy-p-benzoquinone
nitro-p-benzoquinone
phenyl-p-benzoquinone
1,2-naphthoquinone
1,4-naphthoquinone
9,10-anthraquinone
9,10-phenanthraquinone
1,2-benzanthraquinone
2,3-benzanthraquinone
2-methyl-1,-4-naphthoquinone
β-methylanthraquinone
2,3-dichloronaphthoquinone
β-chloroanthraquinone
2-nitro-9,10-phenanthraquinone
2,2'-dianthraquinonyl ethylene
6,11-acenate-1,2-anthraquinone
1,4-dimethyl anthraquinone
2,3-dimethyl anthraquinone
p-phenyl anthraquinone
2,3-phenyl anthraquinone
2,3-diphenyl anthraquinone
acenaphthene quinone
anthanthrone Additional classes of sensitizers which may be employed include fluorenone, anthrones and other homologs and analogs of anthrone.

Normally the amount of sensitizer employed will vary from about $10^{-2}$ to 10 times the weight of aromatic amine utilized. If the concentration of sensitizer is too high, no reversibility occurs. If it is too low, the effect is barely perceptible.

The products utilizable in this invention are produced by any of a number of convenient methods, as will be apparent to those skilled in the art from a consideration of this specification, especially the examples. The amine, together with the sensitizer, if employed can be mixed with the selected polymer in solution or in the melt, or they can be mixed with the monomer which is then polymerized by any of the procedures described above. The resulting solution can then be cast into the selected shape. Substitution of the amine and sensitizer, if employed, for the polymer plasticizer is also an effective method. The photochromic system can be provided in any convenient form, for example a plate, film, fiber, rod or cylinder. If desired, the system can be protected by lamination of a protective layer.

The coloration process of this invention, since it is biphotonic in nature, exhibits quick response and high intensity of cationic coloration. A further characteristic is that the intensity of coloration varies with the light source. Pulse light and flash light sources are preferred over sources of continuous light. Typical steady light sources include sunlight, ultra-high pressure mercury or xenon lamps, low pressure mercury or xenon lamps and laser lights. Pulse light sources include flash lights and laser pulse lights. The wavelength for radiation, whether steady or pulse light is employed, is 200 to 400 nm. The intensity of coloration can be increased by increasing light intensity, elongating the exposure time or increasing the number of pulses. With continuous light, a few minutes exposure, say up to about 5 to 10 minutes is usually adequate. With pulse light it is rarely necessary to employ more than a few shots, for example 5 to 10.

Figure 3:
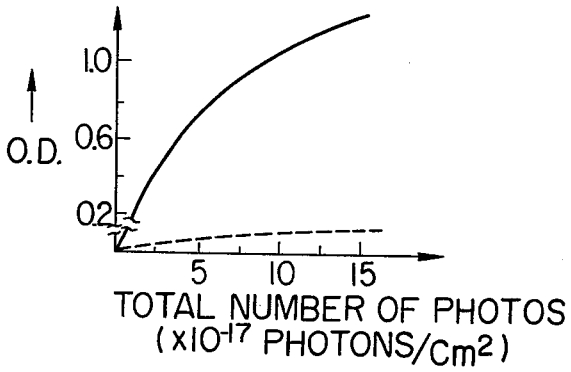
FIG. 3 is a diagram illustrating the effects of light sources upon color generation, velocity of color extinction and degradation of the photochromic system.
Figure 3:
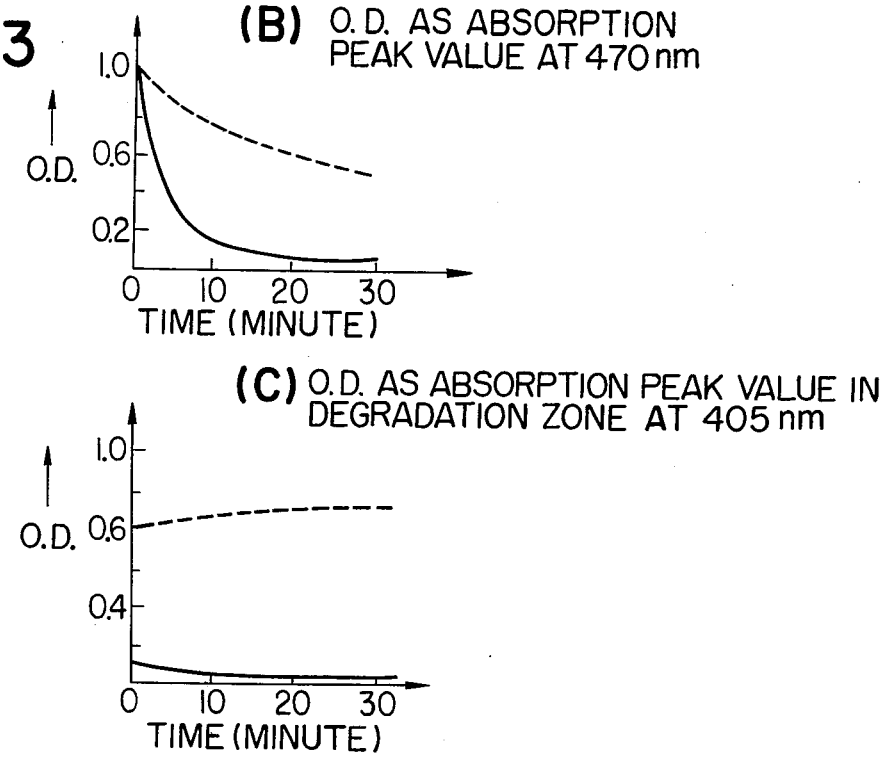

In the practice of this invention, irradiation with a powerful pulse light is more effective for color generation than the irradiation with a steady light, because the quenching of the $T_1$ state by oxygen occurs to a lesser extent and the intensity of coloration is higher. As is shown in FIG. 3, for a fixed total number of photons, the intensity of coloration is about 150 times as high, the velocity of color extinction is about 10 times as fast, and the degradation is about 10 times as slow when pulse light rather than steady light is used.

The pulse light sources which are usable for color generation include flash light sources using such rare gases such as xenon (Xe) and argon and pulse laser sources utilizing nitrogen gas 3371 angstoms, ruby 3471 angstroms and the like.

When the ultra-high pressure 500W Hg lamp and the flash light have substantially the same total number of photons of irradiation light, the flash light has a value of photo-coloration sensitivity about 150 times as high as that of the ultra-high pressure Hg lamp. The same results are also found with a laser pulse light. The laser light, however, is a monochromic light unlike the flash light which involves all regions of the near ultraviolet wavelengths and, therefore, has a smaller number of photons per pulse. For this reason, the laser light has the disadvantage that the number of light pulses must be increased in order to obtain the same degree of intensity of coloration as can be obtained with the flash light. In this sense, the flash light is the more advantageous light source for photochromism with the systems of this invention. If the flash light is used, then the pulse span is on the order below m.sec. and, therefore, is shorter than the life of the $T_1$ state (the life in the polymer being in the range of from several m.sec. to several sec.). Consequently, the possibility of the reactions of decomposition or degradation ascribable to the $T_1$ state is lessened, the velocity of color extinction is increased to about 10 times, and the number of photochromic cycles is increased to about six times. In the flash light used, the light intensity is desirably as high as possible beyond the minimum level of $10^{18}$ photons/cm$^2$.sec. and the pulse period is as short as possible below the maximum level of 100 m.sec.

Color extinction may be accomplished by leaving the system to stand at room temperature for an extended period of time. Irradiation with infrared light or exposure to heat can also return the system to its original colorless state. The application of heat is particularly effective for this purpose. Although the temperature at which the heating is effective for extinction of color varies from as low as 0° C. in some systems to as high as 300° C. with others, the usual range is from about 30° C. to 90° C.

If benzidine or a benzidine derivative is used to induce phosphorescence, a flash light having a high peak intensity is preferred to a steady light for the purpose of enhancing the intensity of coloration. However, the phosphorescence still has a fairly high intensity even when the light used for excitation is a steady light such as of an ultra-high pressure 500W Hg lamp.

When the time lag of phosphorescence is measured by use of an ultra-high pressure 500W Hg lamp, it is found that the time lag varies with the particular kind of polymer medium in use. For example, the time lag is about 60 seconds in polymethyl methacrylate and about 10 seconds in epoxy polymer. For the purpose of extending the time lag, use of a thermoplastic polymer medium which is soft (with a low $T_g$) and excellent in transparency will suffice. Examples of such polymers are polyvinyl acetate, polyethylene, polypropylene, etc.

The length of the time lag is inversely proportional to the sensitivity of coloration or to the emission time of phosphorescence. Because of this inverse relationship, a thermoplastic polymer medium in which photochromic properties including high sensitivity of coloration or long emission time of phosphorescence in combination with long time lag are effectively manifested will be found in a polymer of the rigidity of polymethyl methacrylate or polystyrene, for example.

The process of this invention permits recording even under a room light, and therefore finds extensive utility in dry recording processes which dispense with provision of a dark room.

Systems which incorporate in the polymer benzidine or a derivative to generate bright phosphorescence in addition to photo-coloration have the additional merit of permitting the recorded image to be checked under ordinary light as well as in a dark room.

Because of these advantages, the photochromic methods of the present invention are expected to find utility and to be more advantageous than conventional photochromic procedures in data displays, sign boards, advertisements, public relations media, photoprinting film, printmaking, layout, masking film and other photosensitive procedures.

The following nonlimiting examples are given by way of illustration only.

EXAMPLE 1

Figure 1:
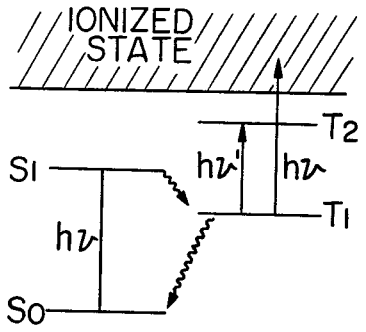
FIG. 1 is an energy diagram typical of an aromatic amine of this invention.
Figure 2:
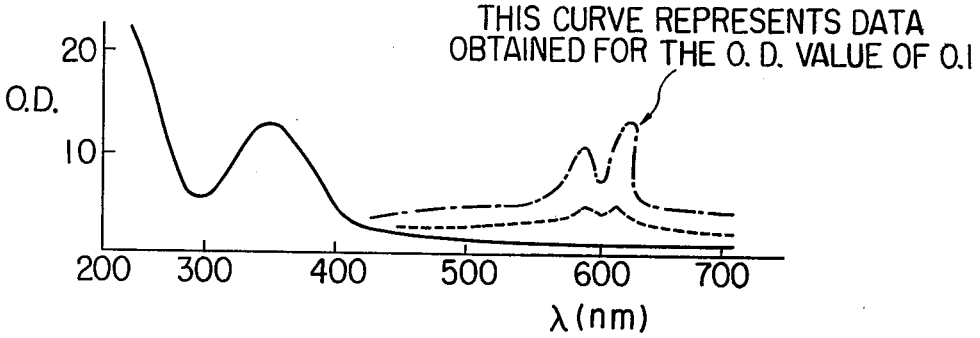
FIG. 2 is a graph showing the absorption spectrum of TMPD in polymethyl methacrylate subsequent to exposure to a flash light and variations in absorption spectrum obtained by exposing the same film to infrared light or to heat.

To polymethyl methacrylate having a molecular weight of 100,000 was added $5\times10^{-2}$% by weight of N,N,N', N'-tetramethyl-p-phenylene diamine. The resultant mixture was dissolved in 220% by weight of benzene. A film 200$\mu$ in thickness was produced from the solution by the solvent cast method. This film was irradiated for about five minutes with near ultraviolet light 200 to 400 nm in wavelength utilizing an ultra-high pressure 500 W mercury lamp through a negative of an original pattern to form a blue positive image. The positive film when left standing at ambient temperature retained the colored image for about five days. When it was exposed to infrared light or to heat at about 80° C. for about five minutes, it resumed its original colorless state. In this manner, the film could alternately be reversibly photocolored. No color was generated on this film when it was exposed to a weak external light as from a fluoriescent lamp in the room. FIG. 2 shows the spectrum of color generation and extinction. In the graph, the solid line represents the absorption spectrum obtained prior to irradiation by light, the alternate one-long and one-short dash line represents the absorption spectrum immediately after irradiation of a flash light and the dotted line represents the absorption spectrum after exposure to infrared lights or heat (about 80° C.) subsequent to the irradiation by a flash light.

EXAMPLE 2

Photochromic film was prepared in the same way as Example 1 employing polystyrene having a molecular weight of 300,000 as a film base. This film was irradiated for about three minutes with near ultraviolet light from an ultra-high pressure 500 W mercury lamp to generate a clearly visible blue color. When it was exposed to infrared light or to heat at about 70° C. for about five minutes, it was discolored. This reversible color generation could be repeated more than 30 times.

EXAMPLE 3

To polymethyl methacrylate having a molecular weight of 200,000 was added N,N'-diphenyl-p-phenylene diamine in the same manner as Example 1. Photochromic film was produced from the solution by the solvent cast method. This film was irradiated for about ten minutes with near ultraviolet light from an ultra-high pressure 500 W mercury lamp through a negative to form a yellow positive. When it was exposed to infrared light or to heat at about 90° C. for about 10 minutes, in the same manner as Example 1, it returned to its original colorless state. This reversible color generation could be repeated more than 10 times.

EXAMPLE 4

To polymer base of polystyrene having a molecular weight of 300,000 was added N,N'-diphenyl-p-phenylene diamine in the same manner as Example 1. A film was produced from the solution by the solvent cast method. The phenomena observed was the same as in Example 3.

EXAMPLE 5

To methyl methacrylate monomer were added $2\times10^{-2}$% by weight of N,N,N',N'-tetramethyl-p-phenylene diamine (TMPD) and $5\times10^{-2}$% by weight of azobisisobutyronitrile. The resultant mixture was deaerated. The photochromic product containing TMPD in polymethyl methacrylate was produced by thermal polymerization. This sample was a transparent cylinder 1 cm in diameter. Then this sample was irradiated for about one minute with near ultraviolet light (200 to 400 nm) from an ultra-high pressure 500 W mercury lamp to generate a blue color on the surface of the cylinder. This color was dissipated by irradiation with infrared light or heating. For extinction of color, the cylinder was exposed to infrared light for two minutes using a 100 W lamp or heat at about 80° C. for about one minute. This reversible color generation could be repeated more than 20 times.

EXAMPLE 6

This example compares the intensity of coloration which can be obtained utilizing an ultra-high pressure 500 W mercury lamp and an argon flash light.

One sample identical to Example 5 was irradiated with near ultraviolet light from a 500 W mercury lamp for one minute. Another sample was subjected 3 times to the light from an argon flash lamp having an intensity of 500 W. The intensity of coloration obtained from both samples was the same. However, the total elapsed irradiation time was only a few seconds compared to one minute for the mercury lamp. Application of heat at about 80° C. for about two minutes returned the sample to its original colorless state. This color generation and extinction was carried out alternately more than 20 times.

EXAMPLE 7

A film 100μ in thickness of a copolymer of vinylidene and vinyl chloride in the molar ratio of 4 to 1 was immersed in an acetone solution containing TMPD for about one hour, and substitution of TMPD for a plasticizer contained in the copolymer film was carried out.

This sample was dried in a vacuum drier for about one hour. It was then irradiated for about five seconds with near ultraviolet light of an ultra-high pressure 500 W mercury lamp. The intensity of coloration obtained was the same as that of Example 6. An intensity of coloration a few times greater than that of Example 6 was obtained by one shot of an argon flash light. When left to stand at room temperature for five days, the original colorless state was restored. It was also restored by heating to about 50° C. This color generation and extinction could be alternately carried out more than 20 times.

Comparative Example

To methyl methacrylate monomer were added $3\times10^{-2}$% by weight of aniline and $5\times10^{-2}$% by weight of azobisisobutyronitrile. The resultant mixture was deaerated and thermally polymerized to produce polymethyl methacrylate containing aniline. The ionization potential of aniline is 7.7 eV.

This sample was a transparent cylinder 1 cm in diameter. To this sample near ultraviolet light from an ultra-high pressure 500 W mercury lamp and an argon flash light were applied but no color was generated by absorption of two photons of aniline.

EXAMPLE 8

An epoxy resin formed by reacting 100 parts of vinyl cyclohexene dioxide with 15 parts of 4-aminomethyl-1,8-diaminooctane containing $1.7\times10^{-1}$% by weight of N,N,N',N'-tetramethyl-p-phenylene diamine was molded in the shape of a plate about 1 mm in thickness. For comparison with this sample, a polymethyl methacrylate plate of the same thickness was prepared containing the same aromatic amine at the same concentration. Preparation was made by adding the aromatic amine to the polymer dissolved in benzene, molding the solution to the shape of a plate and removing the solvent by heating and drying. The two plates were each placed 30 cm from a xenon-flash lamp (500 W, having a pulse rate of 10 m.seconds), exposed each to five pulses of the light from the lamp and then tested for optical density (O.D.) at an absorption peak of 610 nm. The O.D. value was about 1.2 for the epoxy resin plate and 0.3 for the polymethyl methacrylate plate, indicating a notable increase in the sensitivity of coloration. When the two plates were left standing at ambient temperature, the total period required for complete extinction of color was seven days for the epoxy resin and about three days for the polymethyl methacrylate plate, indicating that epoxy resin had a better stabilization effect on the $T_2$ state of the amine. The number of photochromic cycles was counted until the O.D. value of the peak at 450 nm after extinction of color first exceeds the level of 0.1. The number was 30 for the epoxy resin and 10 for the polymethyl methacrylate plate, indicating that the epoxy resin was superior to the polymethyl methacrylate resin in resistance to degradation.

EXAMPLE 9

To 100 parts of a novolak resin having a molecular weight of about 500 and a phenol to formaldehyde molar ratio of 3:1 were added 10 parts of hexamethylene tetramine. There was also added to the mixture $1.7\times10^{-1}$% by weight of N,N,N',N'-tetramethyl-p-phenylenediamine. The solution was molded to form a plate 0.5 mm in thickness.

For comparison in sensitivity of coloration, a polymethylmethacrylate plate was produced by the procedure of Example 8. A xenon flash lamp was employed, and when five pulses of light were applied, the O.D. value was 1.1 for the phenol resin plate and 0.3 for the polymethylmethacrylate plate, indicating that the phenol resin plate was higher in sensitivity.

When comparison plates were irradiated for two minutes with steady light from a distance of 30 cm with an ultra-high pressure 500 W mercury lamp, the obtained O.D. values at 610 nm were 0.5 for the phenol resin and 0.1 for the polymethylmethacrylate plate, indicating that the use of a pulse light was more productive of color despite the fact that the total amount of exposure was more in the case of the ultra-high pressure 500 W mercury lamp.

EXAMPLE 10

To one mol of melamine was added two to three mols of formaldehyde. To 100 parts of melamine resin syrup which were obtained were added 10 parts of α-cellulose, and $2\times10^{-1}$% by weight of N,N,N',N'-tetramethylbenzidine. This sample was heated at about 100° C. for three hours to produce a plate about 0.5 mm in thickness. For the purpose of comparison in sensitivity of coloration, a similar sample plate was produced with the same concentration of benzidine derivative in polymethylmethacrylate. The comparison for sensitivity of coloration was carried out as in Example 8. The results were as follows. The O.D. value at 540 nm was 1.3 for the melamine plate and 0.3 for the polymethylmethacrylate plate.

EXAMPLE 11

To 100 parts of unsaturated polyester having a molecular weight of about 1000 produced by reacting maleic acid anhydride and ethylene glycol in the molar ratio of 2 to 1, were added 10 parts of methyl methacrylate and 0.1 parts of benzoyl peroxide. To this unsaturated polyester system was added $1\times10^{-1}$% by weight of N,N,N',N'-tetramethylbenzidine, and the mix was heated for two hours at 60° C. and then for three hours at 110° C. to produce a molded plate 0.5 mm in thickness.

A comparative sample similarly prepared from polymethyl methacrylate as in Example 10. Each plate was compared for color generation using the procedure of Example 8. The O.D. value was 1.0 for the cross linked unsaturated polyester plate, and 0.3 for the polymethyl methacrylate plate.

EXAMPLE 12

A novolak type phenol resin was subjected to terminal amination and then a polymer with a molecular weight of about 500 and including a diazonium salt, the polymer being designated by the following formula was dissolved in methyl-ethyl-ketone.

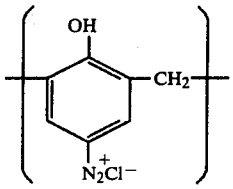

To the polymer was added $1.7\times10^{-1}$% by weight of N,N,N',N'-tetramethylbenzidine. The mixture was coated on a glass plate. A hard coat of about 0.5 mm in thickness was obtained by curing with an ultra-high pressure 500W mercury lamp.

A comparative sample was prepared and tested in the same way as in Example 11. The O.D. value was 0.85 for the polymer of the diazo type and 0.3 for polymethylmethacrylate.

EXAMPLE 13

To 100 parts of a copolymer of methyl methacrylate and acrylonitrile having a molecular weight of about 50,000 were added 20 parts of pentaerythritoltriacrylate and 1 part of α-methylanthraquinone. To the above mixture was added 1 part of N,N'-diphenyl-p-phenylene diamine. The resultant mixture was coated on a glass plate and cured by irradiation for about five minutes using an ultra-high pressure 500W mercury lamp to produce a film 0.5 mm in thickness. A comparison sample plate was prepared in the same way as in Example 12. The plates were prepared for color generation. The O.D. value was 0.9 for the crosslinked resin sample and 0.3 for the polymethylmethacrylate sample.

EXAMPLE 14

To 100 parts of unsaturated polyester prepared from maleic acid anhydride and ethylene glycol were added 10 parts of styrene, 1 part of benzoinmethylether and 0.5 parts of N,N'-diphenyl-p-phenylene diamine. The resultant mixture was cured by the photocrosslinking using an ultra-high pressure 500 W mercury lamp to produce a plate about 0.5 mm in thickness.

A comparative sample of polymethylmethacrylate plate was prepared as in Example 8. The O.D. value was 0.6 for the unsaturated polyester plate and 0.3 for plymethyl methacrylate.

EXAMPLE 15

Into 25 g of methyl methacrylate (hereinafter abbreviated as "MMA") syrup were mixed $2.5\times10^{-1}$% by weight of N,N,N',N'-tetramethyl benzidine (TMB) and 0.05% by weight of azobisisoburyronitrile (hereinafter abbreviated as "AIBN"). The resultant mixture was deaerated, stirred, cast into a reinforced sandwich-shaped glass mold, compressed to effect evacuation of air, and heated at 60° C. for two hours, followed by an additional four hours at 110° C. to effect thermal polymerization. When the polymethyl methacrylate plate (about 2 mm in thickness) was exposed to the light of an ultra-high pressure 500W Hg lamp (200 to 400 nm) for two minutes (dosage $1.5\times10^{19}$ photons/cm$^2$) a yellow color was produced (O.D.=0.2 at $\lambda_{max}$=470 nm). When the colored plate was heated at about 70° C. with a 250W infrared lamp, the color was completely extinguished within five minutes. A total of 30 photochromic cycles was carried out. When another plate from the same lot was irradiated once with a 500W xenon flash light having a pulse time of 1 m.sec (dosage $2.5\times10^{17}$ photons/cm$^2$), a yellow color was produced (O.D.=0.4 at $\lambda_{max}$=470 nm). When the colored plate was heated at about 70° C. with a 250W infrared lamp, the color was extinguished within one minute. A total of 60 photochromic cycles was carried out. From a comparison of the results given above, it is seen that use of a xenon flash lamp as the source of irradiation light for color was more effective than the mercury lamp for the generation of color, velocity of color-extinction and freedom from degradation. Refer to FIG. 5.

EXAMPLE 16

The same sample of Example 15 was irradiated for one minute with an ultra-high pressure 500W Hg lamp (200 to 400 nm) through a negative film of a letter A as shown in FIG. 4. As a result, a yellow colored letter A was produced on the polymethyl methacrylate plate ($\lambda_{max}$=470 nm, O.D.=0.1). This polymethyl methacrylate plate was again irradiated for a few seconds from the same source. This resulted in a part of the letter A emitting phosphorescence of a yellowish green color. The time lag of phosphorescence was one minute. When the experiment was repeated to produce a yellow coloration with an O.D. of 0.4, the intensity of phosphorescence was higher (about 2 mW/cm$^2$). The period of phosphorescence was about ten seconds. The image was readily visible in a dark room. Phosphorescence of not less than 0.5 mW/cm$^2$ was always observed by irradiation of yellow color with O.D. of 0.1. When this plate was heated to about 70° C. with a 250W infrared lamp, as described in Example 15, the color was extinguished within a few minutes. In this state the phosphorescence was not observed even following irradiation. The yellow colored letter A was again formed and the colored plate was irradiated for a few seconds to again cause phosphorescence. This color generation and extinction was carried out alternately 40 times.

EXAMPLE 17

Three samples, each about 2 mm thick were prepared, each containing $2.5\times10^{-1}$% of TMB. In I the benzidine derivative was in the polymethyl methacrylate of Example 15. Sample II contained it dispersed in the epoxy resin of Example 8. The carrier in sample III was polystyrene. The samples were irradiated for about one minute with an ultra-high pressure 500W Hg lamp (200 to 400 nm) to measure the time lag of phosphorescence of TMB, the emission time of phosphorescence, and the intensity of coloration. The results are shown in Table 2.

Table 2

| Sample | Time lag | Emission time of phosphorescence | Intensity of coloration, O.D. value |
|---|---|---|---|
| I | 60 (seconds) | 12 (seconds) | 0.1 |
| II | 50 | 12 | 0.08 |
| III | i | 19 | 0.2 |

The time of color extinction and the number of photochromic cycles in the samples are shown in Table 3.

Table 3

| Sample | Color extinction time (250W infrared lamp) | Number of photo chromic cycles |
|---|---|---|
| I | 5 minutes (70° C.) | 40 |
| II | 6 minutes (70° C.) | 35 |

Table 3-continued

| Sample | Color extinction time (250W infrared lamp) | Number of photo chromic cycles |
|---|---|---|
| III | 10 minutes (70° C.) | 20 |

From Table 2, it will be seen that the length of the time lag is inversely proportional to the intensity of coloration and to the emission time of phosphorescence. In samples I and II the time lag was relatively long and the color intensity low. With the more rigid carriers these values were reversed.

EXAMPLE 18

To MMA syrup were added $2.5\times10^{-1}$% by weight of benzidine and 0.05% by weight of AIBN, and a PMMA plate was produced from the solution as described in Example 15. This plate was irradiated for five minutes with light from an ultra-high pressure 500W HG lamp (200 to 400 nm) to produce a colored state with an O.D. of 0.1 having an absorption peak at $\lambda$=460 nm. This color was extinguished when subjected to heat at about 70° C. with a 250W infrared lamp for about ten minutes. The number of cycles was 15.

When the sample was irradiated (200 to 400 nm) for a few additional seconds after the production of the colored state, phosphorescence similar to that of Example 16 was observed.

EXAMPLE 19

To MMA syrup were added $2.5\times10^{-1}$% by weight of N,N-dimethyl-2,2'-dimethoxy benzidine and 0.05% by weight of AIBN and a PMMA plate was produced as described in Example 15. This plate was irradiated for two minutes with light from an ultra-high pressure 500W Hg lamp (200 to 400 nm) to produce a colored state with an O.D. of 0.1 which had an absorption peak at $\lambda$=465 nm. This color was extinguished when it was exposed to heat at about 80° C. for about seven minutes with a 250W infrared lamp. The number of photochromic cycles was 15. Further irradiation as described in Example 18 caused phosphorescence.

EXAMPLE 20

To MMA syrup were added $2.5\times10^{-1}$% by weight of N,N,N',N'-tetraphenyl benzidine and 0.05% of AIBN. A PMMA plate was produced as described in Example 15. This plate was irradiated for about one minute with light from an ultra-high pressure 500W Hg lamp (200 to 400 nm) to produce a colored state with an O.D. of 0.2 which had an absorption peak at $\lambda$=485 nm. This color was extinguished when exposed to heat at about 70° C. for five minutes with a 250W infrared lamp. The number of photochromic cycles was 30. Phosphorescence was observed as in the previous examples.

EXAMPLE 21

To MMA syrup were added $2.5\times10^{-1}$% by weight of N,N'-bisbenzilidene benzidine and 0.05% by weight of AIBN, and a PMMA plate was produced as in Example 15. This plate was irradiated for about three minutes with light from an ultra-high pressure 500W Hg lamp (200 to 400 nm) to produce a colored state with an O.D. of 0.1 which had an absorption peak at $\lambda$=465 nm. This color was extinguished when it was exposed to heat at about 70° C. for eight minutes with a 250W infrared lamp. The number of photochromic cycles was 20. A yellowish green phosphorescence with a time lag of three minutes and an emission time of six seconds was observed when it was irradiated (200 to 400 nm) as described in Example 16.

EXAMPLE 22

A plate of 1 mm in thickness which was produced by adding $2.5\times10^{-1}$% by weight of N,N'-bisbenzylidene benzidine to the epoxy polymer of Example 8. It was irradiated for about ten seconds with light from an ultra-high pressure 500W Hg lamp (200 to 400 nm) to produce a colored state with an O.D. of 0.1 which had an absorption peak at $\lambda=468$ nm. This color was extinguished when it was exposed to heat at about 85° C. for ten minutes with a 250W infrared lamp. The number of photochromic cycles was 20. A yellowish green phosphorescence with a time lag of ten seconds and an emission time of ten seconds was observed when it was irradiated (200 to 400 nm) as described in Example 16.

EXAMPLE 23

To MMA syrup were added $2.5\times10^{-1}$% by weight of p-dianisal benzidine and 0.05% by weight of AIBN and a PMMA plate was produced as described in Example 15. This plate was irradiated for about one minute with light from an ultra-high pressure 500W Hg lamp (200 to 400 nm) to produce a colored state with an O.D. of 0.1 which had an absorption peak at $\lambda=470$ nm. This color disappeared when exposed to heat at about 70° C. for five minutes with a 250W infrared lamp. The number of photochromic cycles was 25. A yellowish green phosphorescence with a time lag of one minute and an emission time of twelve seconds was observed when it was irradiated (200 to 400 nm) as described in Example 16.

EXAMPLE 24

A plate 1 mm in thickness which was produced by adding $2.5\times10^{-1}$% by weight of p-dianisal benzidine and 0.05% by weight of AIBM to the epoxy polymer was irradiated for about ten seconds with light from an ultra-high pressure 500W Hg lamp (200 to 400 nm) to produce a colored state with an O.D. of 0.1 which had an absorption peak at $\lambda=470$ nm. This color was extinguished when it was exposed to heat at about 70° C. for eight minutes with a 250W infrared lamp. The number of photochromic cycles was 30. A yellowish green phosphorescence with time lag of ten seconds and an emission time of 19 seconds was observed when it was irradiated (200 to 400 nm) as described in Example 16.

EXAMPLE 25

To PMMA with a molecular weight of 100,000 was added $2.5\times10^{-1}$R by weight of TMB. The resultant mixture was dissolved in 220% by weight of benzene. A film 200$\mu$ in thickness was produced from the solution by the solvent cast method. This film was irradiated for two minutes with light from an ultra-high pressure 500W Hg lamp (200 to 400 nm) to produce a colored state with an O.D. of 0.1 which had an absorption peak at $\lambda=470$ nm. This color was extinguished when it was exposed to heat at about 70° C. for four minutes with a 250W infrared lamp. The number of photochromic cycles was 30. A yellowish green phosphorescence with a time lag of two minutes and an emission time of seven seconds was observed when it was irradiated (200 to 400 nm) as described in Example 16.

EXAMPLE 26

A film was produced as described in Example 25 by adding $2.5\times10^{-1}$% by weight of TMB to polystyrene with a molecular weight of 300,000. This film was irradiated for two minutes with light from an ultra-high pressure 500W Hg lamp (200 to 400 nm) to produce a colored state with an O.D. of 0.1 which had an absorption peak at $\lambda=470$ nm. This color was extinguished when it was exposed to heat at about 70° C. for four minutes with a 250W infrared lamp. The number of photochromic cycles was 30. A yellowish green phosphorescence with a time lag of two minutes and an emission time of eight seconds was observed when ti was irradiated (200 to 400 nm) as described in Example 16.

EXAMPLE 27

To polyacrylonitrile with a molecular weight of 200,000 was added $2.5\times10^{-1}$% by weight of TMB. The resultant mixture was dissolved in 300% by weight of dimethyl formamide. A film 200$\mu$ in thickness was produced from the solution by the solvent cast method. This film was irradiated for one minute with light from an ultra-high pressure 500W Hg lamp (200 to 400 nm) to produce a colored state with an O.D. of 0.1 which had an absorption peak at $\lambda=475$ nm. This color was extinguished when it was exposed to heat at about 70° C. for seven minutes with an infrared lamp. The number of photochromic cycles was 20. A yellowish green phosphorescence with a time lag of one minute and an emission time of eight seconds was observed when it was irradiated (200 to 400 nm) as described in Example 16.

EXAMPLE 28

N,N,N',N'-tetramethyl-p-phenylene diamine ($1.7\times10^{-1}$% by weight) and azo-bisisobutyronitrile (0.05% by weight) were mixed in MMA syrup, deaerated, stirred, cast into a reinforced sandwich-shaped glass mold, and compressed to effect evacuation of air. It was heated at 60° C. for two hours and further at 110° C. for four hours to achieve thermal polymerization. The PMMA plates, each about 2 mm in thickness, were irradiated with flash light from an ultra-high pressure 500W Hg lamp and a 500W xenon flash lamp with a pulse period of about 1 m.sec. used as the sources of irradiation (200 to 400 nm) for color generation to test the plates for sensitivity of color activation and extinction and number of photochromic cycles. The results were as shown in Table 4. When the two light sources were tested for number of photons (200 to 400 nm), it was confirmed that one pulse of the flash light from the 500W xenon flash lamp and two seconds of irradiation by the ultra-high pressure 500W Hg lamp were equal in total number of irradiation photons. In the Table, the intensity of coloration is expressed in O.D. values at the absorption peak $\lambda=610$ nm (blue), the duration of color extinction is expressed as the half-life period in hours required for the value of O.D. to fall from 0.4 to 0.2 while heating at about 70° C. with a 250W infrared lamp, and the number of photochromic cycles is expressed as the number of cycles until the O.D. values of the degraded products (exhibiting absorption at $\lambda=450$ nm) reached a low of 0.2.

Table 4

| | Hg lamp | Xenon lamp | Comparison between the two light sources (for flash light) |
|---|---|---|---|
| Color generation | 0.4/5 minutes | 0.4/1 pulses | 150 times |
| Color extinction | 21 minutes | 2 minutes | ~10 times |
| Number of cycles | 5 | 30 | 6 times |

EXAMPLE 29

The sample of Example 28 was irradiated with light from an ultra-high pressure 500W Hg lamp and a nitrogen gas laser lamp with a pulse period of 10 m.sec. shown in Table 5 used as the sources of irradiation (200 to 400 nm) for color generation to test the plates for sensitivity, extinction, and number of cycles. The results which were measured as in the previous example are shown in Table 5. When the two light sources were tested for number of photons (200 to 400 nm), it was confirmed that 100 pulses of the flash light from the nitrogen gas laser lamp and one second of irradiation from the ultra-high pressure 500W Hg lamp were equal in total number of irradiation photons.

Table 5

| | Hg lamp | Laser light | Comparison between the two light sources (for laser light) |
|---|---|---|---|
| Color generation | 0.4/5 minutes | 0.4/250 pulses | 120 times |
| Color extinction | 21 minutes | 2.5 minutes | ~8 times |
| Number of cycles | 5 | 28 | ~6 times |

EXAMPLE 30

Two samples of Example 28 were irradiated with light from an ultra-high pressure 500W Hg lamp and a giant pulse ruby laser light with a pulse rate of 15 m.sec. shown in Table 6 used as the sources of irradiation lights (200 to 400 nm) for color generation to test for photochromic sensitivity and number of photochromic cycles. The results were as shown in Table 6. When the two light sources were tested for number of photons (200 to 400 nm), it was confirmed that 10 pulses of the flash light from the giant pulse ruby laser light and one second of irradiation by the ultra-high pressure 500W Hg lamp were equal in total number of irradiation photons.

Table 6

| | Hg lamp | Laser light | Comparison between the two light sources |
|---|---|---|---|
| Color generation | 0.4/5 minutes | 0.4/22 pulses | 135 times |
| Color extinction | 21 minutes | 2.3 minutes | ~9 times |
| Number of cycles | 5 | 30 | ~6 times |

EXAMPLE 31

To polystyrene having a molecular weight of 300,000 was added N,N,N',N'-tetramethyl-p-phenylenediamine ($1.7\times10^{-1}$% by weight) and the mixture was dissolved in benzene (200% by weight). A film 0.2 mm in thickness was produced from the solution by the solvent cast method. Two samples of this film were irradiated with light from an ultra-high pressure 500W Hg lamp and a 500W xenon lamp with a pulse rate of 1 m.sec. used as the sources of irradiation light (200 to 400 nm) for color generation to test the film photochromic sensitivity and number of photochromic cycles. The results were as shown in Table 7.

Table 7

| | Hg lamp | Xenon lamp | Comparison between the two light sources |
|---|---|---|---|
| Color generation | 0.4/15 minutes | 0.4/3 pulses | 150 times |
| Color extinction | 10 minutes | 1 minute | ~10 times |
| Number of cycles | 4 | 25 | ~6 times |

EXAMPLE 32

In the same manner as in Example 28, two PMMA plates about 2 mm in thickness containing N,N'-diphenyl-p-phenylenediamine were produced. The plates were irradiated as described in the previous example. The results were as shown in Table 8.

Table 8

| | Hg lamp | Xenon light | Comparison between the two light sources |
|---|---|---|---|
| Color generation | 0.4/8 minutes | 0.4/2 pulses | 120 times |
| Color extinction | 22 minutes | 2 minutes | ~11 times |
| Number of cycles | 4 | 27 | ~7 times |

EXAMPLE 33

Plates 1 mm in thickness were produced by adding N,N,N',N'-tetramethyl-p-phenylenediamine ($1.7\times10^{-1}$% by weight) to epoxy polymer of Example 8. These plates were irradiated as in Example 28. The results were as shown in Table 9.

Table 9

| | Hg lamp | Xenon light | Comparison between the two light sources |
|---|---|---|---|
| Color generation | 0.4/3 minutes | 0.4/¾ pulses | 120 times |
| Color extinction | 28 minutes | 3 minutes | 9 times |
| Number of cycles | 3 | 20 | ~7 times |

EXAMPLE 34

To 100 parts of photo-crosslinking type unsaturated polyester composed of 4 parts of maleic acid anhydride and 1 part of ethylene glycol was added $1\times10^{-1}$% by weight of N,N,N',N'-tetramethyl-p-phenylenediamine. The resultant mixture was coated on a glass plate. This product was cross-linked with light from an ultra-high pressure 500 W mercury lamp to produce a plate 1 mm in thickness. The photochromic cycles were measured as described in Example 28. The results were as shown in Table 10.

Table 10

| | Hg lamp | Xenon light | Comparison between the two light sources |
|---|---|---|---|
| Color generation | 0.3/3 minutes | 0.4/¾ pulses | 160 times |
| Color extinction | 20 minutes | 3 minutes | 7 times |
| Number of cycles | 3 | 20 | ~7 times |

Example 35

To 100 parts of thermo-cross-linking type unsaturated polyester composed of adipic acid, maleic acid, ethylene glycol and fumaric acid in a mole ratio of 1:1:1:1 was added $1.5\times10^{-1}$% by weight of N,N,N',N'-tetramethyl-p-phenylenediamine. The resultant mixture was applied to a glass plate. This polymer was cross-linked with heat of 80° C. for four hours to produce a film about 200μ in thickness. The photochromic sensitivity and the number of photochromic cycles were measured as described in Example 28. The results were as shown in Table 11.

Table 11

| | Hg lamp | Xenon light | Comparison between the two light sources |
|---|---|---|---|
| Color generation | 0.4/3 minutes | 0.4¾ pulses | ~120 times |
| Color extinction | 20 minutes | 3 minutes | 7 times |
| Number of cycles | 3 | 20 | 7 times |

EXAMPLE 36

To 5 g of polymethyl methacrylate having a molecular weight of 100,000 were added $5\times10^{-2}$% by weight of N,N,N',N'-tetramethyl-p-phenylenediamine and $5\times10^{-2}$% by weight of p-chloranil (electron affinity of 1.6 eV). The resultant mixture was dissolved in 220% by weight of benzene. From the resultant solution, a film 200μ in thickness was produced by the solvent cast method. When this film was irradiated for about one minute with near ultraviolet light of 200 to 400 nm in wavelength from an ultra-high pressure 500 W mercury lamp plated at a distance of 30 cm through a negative of an original pattern, a blue positive image was formed. This positive image had an O.D. of 1.0. The image could be retained for seven days at room temperature. When the image was heated at 80° C. immediately after generation of color, the film returned to its original colorless state in about five minutes. In this manner, the film could be subjected to a total of more than 30 photochromic cycles. For comparison, a system was prepared similarly except for exclusion of p-chloranil. When the film of this system was subjected to photo-coloration and color-extinction, the sensitivity of coloration was only about one fifth and the life time of coloration was shorter. When it was left to stand at room temperature, it returned to its original colorless state in about three days.

When a film of a system in which a sensitizer was added was irradiated with one pulse from a 500W xenon flash lamp at a distance of 30 cm, a blue positive image of O.D. of 1.5 was obtained. This sensitivity of color generation was better by about 50 times than from an ultra-high pressure 500 W Hg lamp.

EXAMPLE 37

To 20 ml of methyl methacrylate were added with stirring $10^{-2}$ mol/l of N,N,N',N'-tetramethyl-p-phenylene diamine, $10^{-2}$ mol/l of 1,2-benzanthraquinone (electron affinity of more than 1 eV), and $5\times10^{-3}$ mol/l of azobisisobutyronitrile. The resultant mixture was deaerated and then cast into a molded rubber spacer on a glass plate. It was covered with another glass plate and heated at 70° C. for six hours and at 110° C. for an additional three hours to produce a transparent plate about 1 mm in thickness. This plate was irradiated with one pulse from a zenon flash lamp (pulse period 1 m.sec., light strength $2.5\times10^{17}$ photon/pulse). As a result, there appeared a blue color on the plate having an O.D. of 1. When it was heated at 90° C. for about one minute it returned to its colorless state. This color generation and extinction could be repeated more than 30 times. For comparison, a plate which was produced without adding 1,2-benzoanthraquinone was tested. This plate was irradiated with flash lights of about 10 pulses from the same lamp. The intensity of coloration was the same as above despite the exposure to 10 times the number of pulses.

EXAMPLE 38

In 50 ml of benzene were dissolved 10 gr of polystyrene having a molecular weight of 300,000. To this solution were added $10^{-2}$ mol/l each of N,N'-diphenyl-p-phenylenediamine and 5-nitroacenaphthene (electron affinity of more than 1 eV). The solution was coated on a glass plate and dried to produce a film 100μ in thickness. This film was irradiated for about one minute with flash light from an ultra-high pressure 500 W mercury lamp through a Tohshiba UVD-25 filter (200 to 400 nm) to cause the appearance of a blue coloration (O.D. of 1.2). This colored image, when left standing at room temperature, could be retained for about seven days. When it was exposed to heat at 80° C. for about one minute, it resumed its colorless, transparent state.

The number of photochromic cycles was about 10 and gradually a yellow colored image appeared. A similar film, but with no sensitizer, required about ten minutes of irradiation to produce the same intensity of coloration.

EXAMPLE 39

A photochromic plate was produced from the combination of N,N'-diphenyl-p-phenylene diamine in styrene and 9,10-anthraquinone (electron affinity of more than 1 eV) by the same procedure as in Example 37. The addition contents were each $10^{-2}$ mol/l. To generate color, a xenon flash light was used and an intensity of coloration of O.D. of 0.9 was obtained by irradiating one pulse. For comparison, when a plate which did not contain a sensitizer was used, the intensity of coloration produced by irradiation with one pulse was only 0.4.

EXAMPLE 40

In the same manner as in Example 36, a film was produced by mixing $10^{-2}$ mol/l of N,N,N',N'-tetramethyl benzidine and $10^{-3}$ mol/l of 9-nitropyrene (electron affinity of more than 1 eV) into a polyvinylchloride polymer. Using the second harmonics of a giant pulse ruby laser of 30 MV, the film was irradiated one pulse of the flash light, to form a yellow colored image with an O.D. value of 1.5. If the sensitizer was omitted, the O.D. value was only 0.4.

EXAMPLE 41

In the same manner as in Example 40, the combination of polyacrylonitrile containing N,N,N',N'-tetramethyl benzidine and indo-p-benzoquinone ($10^{-2}$ mol/l respectively, electron affinity of more than 1 eV) was irradiated with light (337 nm) of an $N_2$ gas pulse laser (0.2 MV). The O.D. value was 1.4 when irradiated one pulse but only 0.3 for a similarly treated composition containing no sensitizer.

EXAMPLE 42

Table 12 shows the sensitization improvements attained by adding the indicated sensitizer to selected aromatic amines in polymethyl methacrylate. The light source was a 50 QW xenon flash lamp with a pulse rate of 1 m.sec. A UVD-25 filter was used.

Table 12

| | Aromatic amine | Sensitizer | Degree of Sensitization |
|---|---|---|---|
| 1 | triphenylamine | 2,4,6-trinotro-toluene | 5 (times) |
| 2 | α-naphthylamine | p-nitrodimethyl aniline | 4 |
| 3 | N,N-dimethyl naphthyl- | 5,6-dinitroacenaph-thene | 3 |
| 4 | 4-octylaniline | 9,10-phenanthra-quinone | 6 |
| 5 | N,N-dibutylaniline | 5,6-dinitroacenaph-thene | 4 |
| 6 | 2,6-dichloro-N,N,N',N'-tetramethyl-p-phenylene diamine | 1,4-naphthoquinone | 15 |

EXAMPLE 43

A film about 100μ in thickness was produced by using the epoxy polymer of Example 8 containing $1.7\times10^{-1}$% by weight of N,N,N',N'-tetramethyl-p-phenylene diamine and $1\times10^{-1}$% by weight of 5-nitroacenaphthene (electron affinity of more than 1 eV).

As a light source for color generation a 500 W xenon flash lamp was used and the optical density of the resulting blue color was 1.2 after only one pulse. In the above Examples 36 to 43, the value of the intensity of coloration (O.D.) used is the value of the maximum absorption peak in the visible region.

EXAMPLE 44

To 80 parts of unsaturated polyester composition which was produced by the same method as in Example 34, were added 2 parts of benzoin isopropyl ether, 8 parts of triethylene glycol diacrylate, 8 parts of dimethyl acrylamide and 0.1 part of azobisisoburyronitrile. To the resultant mixture was added $1\times10^{-1}$ parta of N,N,N',N'-tetramethyl-p-phenylenediamine and $2\times10^{-2}$ parts of 2,4,6,trinitrofluorenone (electron affinity more than 1 eV). The mixture was coated on a glass plate, and this plate was irradiated with light from an ultra-high pressure 500 W mercury lamp to crosslink the polymer and produce a film about 100μ in thickness. When a 500 W xenon flash light was used as the light source for color generation, a blue image was obtained with an intensity of coloration of O.D.=1.0.

EXAMPLE 45

To 60 parts of unsaturated polyester composition which was produced as in Example 35 were added 15 parts of vinyl acetate, 15 parts of methyl methacrylate, 0.1 parts of benzoyl peroxide and 0.3 parts of triethylene amine to produce unsaturated polyester composition. To this composition were added $2\times10^{-2}$ parts of 1,4-naphthoquinone (electron affinity of more than 1 eV). The resultant mixture was stirred and applied to a glass plate. This plate was heated to about 80° C. for three hours to produce a cured film 200μ in thickness. A greenish blue image which was obtained by one pulse of irradiation with a 500 W xenon flash light had an intensity of coloration of O.D.=0.8.

EXAMPLE 46

To 100 parts of a photo-crosslinking type unsaturated polyester composition which was produced as in Example 44, were added $2\times10^{-1}$ parts of N,N,N',N'-tetramethylbenzidine. This mixture was applied to a glass plate and, for curing, was irradiated for about two minutes with light from an ultra-high pressure 500 W mercury lamp to produce a film 200μ thick. This film was irradiated with one pulse from a 500 W xenon flash light to generate a yellow color. It was then irradiated for two seconds with light from an ultra-high pressure 500 W lamp. A yellowish green phosphorescence was observed for about ten seconds when the irradiation was complete. When the film was heated for about one minute with a 250 W infrared light, the yellowish color disappeared and no phosphorescence was observed after the color extinction.

EXAMPLE 47

To 100 parts of a thermo-crosslinking type unsaturated polyester composition was added $1.5\times10^{-1}$ parts of benzidine. The resultant mixture was coated onto a glass plate. It was crosslinked by heating for five hours at 80° C. to produce a film about 100μ thick. This film was irradiated with one pulse from a 500 W xenon flash light to generate a yellow color. This colored film was irradiated for ten seconds with lights from an untra-high pressure 500 W mercury lamp. When the irradiation was complete, greenish yellow phosphorescence was observed for about ten seconds.

What is claimed is:

1. A photochromic method for generating color in a photochromic composition which comprises imagewise exposing of said photochromic composition in the form of a film to a pulse light source having a wavelength of from 200 to 400 nm having a high light intensity of at least $10^{18}$ photons/cm$^2$. sec., said light source having a pulse period of up to 100 m.sec., the said photochromic composition consisting essentially of an aromatic amine having an ionization potential up to 7.6 eV, which absorbs 2 photons of light to generate a photoionization state in the exposed areas of the film and to generate a colored cation and an electron in the exposed areas of said film, said amine being dispersed in a rigid polymer matrix which increases and stabilizes said photoionization state;

the aromatic amine being the sole photochromic substance in the photochromic composition and being selected from the group of amines represented by the formulas

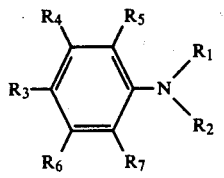

(I)

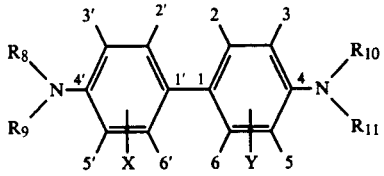

(II)

or

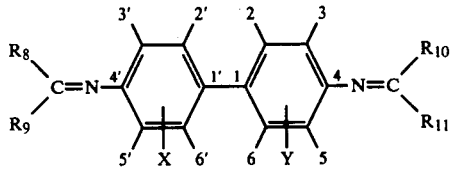

(III)

wherein $R_1$, $R_2$ and $R_4$ to $R_7$ are hydrogen, lower alkyl, lower alkoxy, allyl, substituted allyl, phenyl, substituted phenyl, amino and substituted amino, said substituents being selected from the group consisting of amino, lower alkyl and lower alkoxy; $R_3$ being the same as $R_1$, $R_2$ and $R_4$ to $R_7$, except that the substituents when on an amino group are selected from the group consisting of allyl and phenyl; $R_8$ to $R_{11}$ being selected from the group consisting of hydrogen, lower alkyl, phenyl, substituted phenyl, amino, substituted amino allyl and substituted allyl, substituted having the same meaning as defined above in connection with substituents on $R_1$, $R_2$ and $R_4$ to $R_7$ groups; and X and Y being selected from the group consisting of from 0 to 4 $R_1$, $R_2$, $R_4$ to $R_7$ groups and halogen and sulfonate groups.

2. A photochromic method as in claim 1 wherein the polymer matrix is a thermoplastic polymer having a glass transition temperature of at least 300° K.

3. A photochromic method as in claim 2 wherein the polymer matrix is a polymer having in the main chain or side chain at least one group selected from the class consisting of hydroxyl, chloro, cyano, amido, fluoro, nitro, mercapto, sulfonyl, carboxyl, carbalkoxyl, epoxy group or N-hetero ring groups.

4. A photochromic method as in claim 1 wherein the polymer matrix is a polymer selected from photocrosslinking polymers and thermocrosslinking polymers having at least one cross-link per 1000 repeating units.

5. A photochromic method as in claim 4 wherein the polymer matrix is a polymer containing in the main chain or side chain thereof at least one member selected from the class consisting of oxygen, nitrogen, sulfur, phosphorus, halogen and aromatic rings.

6. A photochromic method as in claim 4 wherein the polymer matrix is a polymer containing in the main chain thereof at least one member selected from the class consisting of aromatic rings and ether, ester, amide and amino groups.

7. A photochromic method as in claim 4 wherein the polymer matrix is a polymer containing in the side chain thereof at least one member selected from the class consisting of aromatic rings and hydroxyl, alkoxy, amino, sulfonate and halogen.

8. A photochromic method as in claim 1 wherein the ionization potential of the aromatic amine is from 5 eV to 7.6 eV.

9. A photochromic method as in claim 1 wherein the amount of aromatic amine is from $10^{-5}$% to 10% by weight based on the weight of the polymer matrix.

10. A photochromic method as in claim 9 wherein the amount of aromatic amine is from $10^{-2}$% to 2% by weight based on the weight of the polymer matrix.

11. A photochromic method as in claim 1 wherein the benzidine derivative is incorporated in am amount of $10^{-4}$% to 25% by weight based on the weight of the polymer matrix.

12. A photochromic method as in claim 11 wherein the benzidine derivative is incorporated in am amount of $10^{-2}$% to 25% by weight based on the weight of the polymer matrix.

13. A photochromic method as in claim 1 wherein the photochromic composition additionally contains a sensitizer having an electron affinity of from about 0.5 eV to 2.5 eV, said sensitizer is an aromatic nitro compound or quinone.

14. A photochromic method as in claim 13 wherein the weight of the sensitizer is from $10^{-2}$ to 10 times the weight of the aromatic amines.

15. A photochromic method as in claim 1 wherein the pulse light is a pulse laser light using a source selected from the group consisting of nitrogen gas and ruby.

16. A photochromic method as in claim 1 wherein the light source is a flash light source.

17. A photochromic method as in claim 16 wherein the flash light source is a xenon or argon lamp.

18. A method as in claim 1 including the further step of extinguishing the color by exposure to a heat source or to infrared radiation.

* * * * *